United States Patent [19]

Thorn et al.

[11] 4,074,460

[45] Feb. 21, 1978

[54] DOLL SIMULATING SUCKING ACTION

[75] Inventors: Herbert Thorn, Great Neck; Harvey Berkin, Merrick, both of N.Y.

[73] Assignee: Ideal Toy Corporation, Hollis, N.Y.

[21] Appl. No.: 701,470

[22] Filed: July 1, 1976

[51] Int. Cl.[2] ..... A63H 13/02

[52] U.S. Cl. ..... 46/135 R; 46/141

[58] Field of Search ..... 46/141, 135 R, 135 A

[56] References Cited

U.S. PATENT DOCUMENTS

| | | | |
|---|---|---|---|
| 3,383,795 | 5/1968 | Ryan et al. | 46/141 X |
| 3,745,696 | 7/1973 | Sapkus et al. | 46/135 R |

*Primary Examiner*—F. Barry Shay

*Attorney, Agent, or Firm*—Richard M. Rabkin

[57] ABSTRACT

The disclosed doll includes an operating mechanism actuated by a simulated baby bottle inserted in the doll's mouth to cause the doll to open and close its eyes and to simulate the action of sucking on the bottle. The mechanism allows the sucking action to be reproduced regardless of the position of the eyes.

21 Claims, 7 Drawing Figures

DOLL SIMULATING SUCKING ACTION

The present invention relates to toy dolls, and more particularly to a toy doll which is adapted to simulate the action of an infant drinking or sucking on a bottle.

A variety of different types of children's toys and dolls have been previously proposed to simulate various actions of infants. A number of such dolls have been provided with simulated baby bottles in order to allow the child to simulate feeding of an infant with a bottle. One such doll, as disclosed in U.S. application Ser. No. 668,239 filed Mar. 18, 1976 by Ned Strongin et al., now U.S. Pat. No. 4,033,071, enables the child playing with the doll to operate a mechanism within the doll's head in order to open and close the doll's eyes and simulate the facial expressions of an infant sucking on the bottle. That mechanism is generally satisfactory in use, but it is somewhat complicated, and only allows the sucking action to be reproduced when the eyes of the doll are closed.

It is an object of the present invention to provide an improved doll asembly which will enable a child to open and close the doll's eyes while simultaneously reproducing facial expressions of the doll simulating sucking on a bottle.

A further object of the present invention is to provide a toy doll which will simulate the facial motions of sucking on a bottle.

Another object of the present invention is to provide a toy doll in which the eyes of the doll can be opened and closed by the child, and which will also enable the child to simulate in the doll the facial expressions of sucking on a bottle, independently of the position of the eyes.

A further object of the present invention is to provide a doll of the character described which is relatively simple in construction and economical to manufacture.

A still further object of the present invention is to provide a doll of the character described which is durable in use.

In accordance with an aspect of the present invention a doll assembly is provided which includes a hollow head portion having a mouth aperture and a pair of flexible cheek portions. An actuator member or rod is slidably mounted in the head for sliding movement towards and away from the mouth aperture while means, such as for example a bracket or frame, mounted on the actuator member for movement therewith is connected to the flexible cheek portions of the doll's head in order to flex the cheek portions inwardly when the actuator is moved away from the mouth aperture.

Movement of the actuator is controlled by a simulated baby bottle having a nipple end portion which is adapted to be received within the mouth aperture of the doll's head and engaged with one end of the actuator member in order to push the actuator member inwardly of the mouth aperture against the bias of a spring arrangement or the like. While the bracket controlling cheek movement is mounted on the actuator rod for longitudinal movement therewith, the rod is rotatably mounted within the bracket for rotational movement independent of its longitudinal movement, and means are provided for operatively connecting the rod to eyeballs in the doll's head for moving the eyeballs between eye open and eye closed position in response to rotation of the actuator rod in a predetermined direction. By this arrangement the eyeballs may be opened or closed in both the flexed and unflexed position of the flexible cheek portions of the doll. Thus control of the cheek flexing and of the eyes are independent from each other.

The above, and other objects, features and advantages of the present invention will be apparent in the following detailed description of an illustrative embodiment thereof, which is to be read in connection with the accompanying drawings, wherein.

Figure 1:
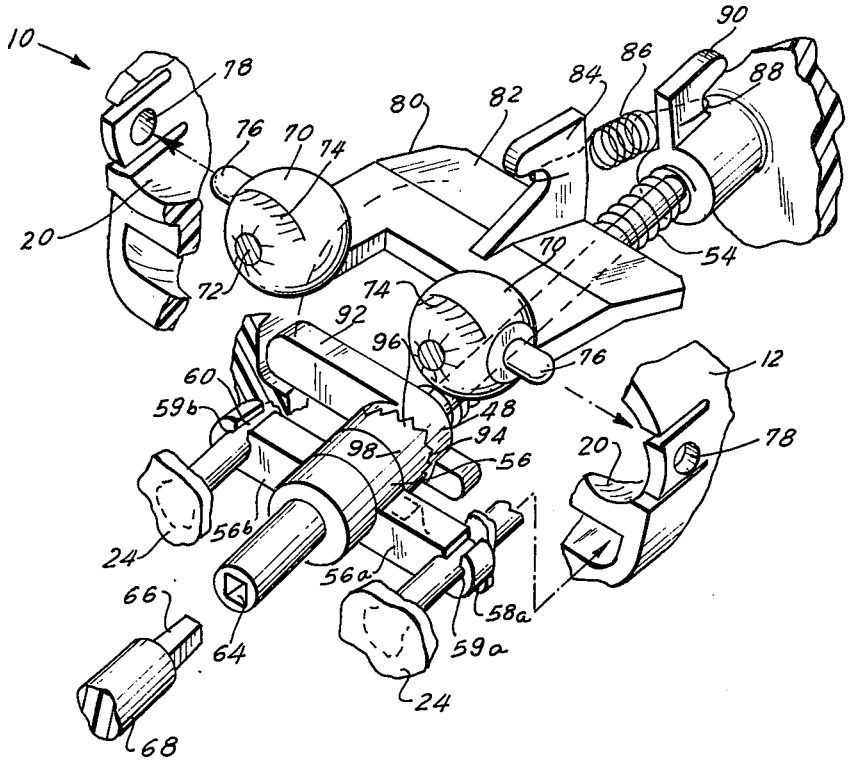
FIG. 1 is an exploded perspective view of the operating mechanism of a toy doll assembly constructed in accordance with the present invention.
Figure 5:
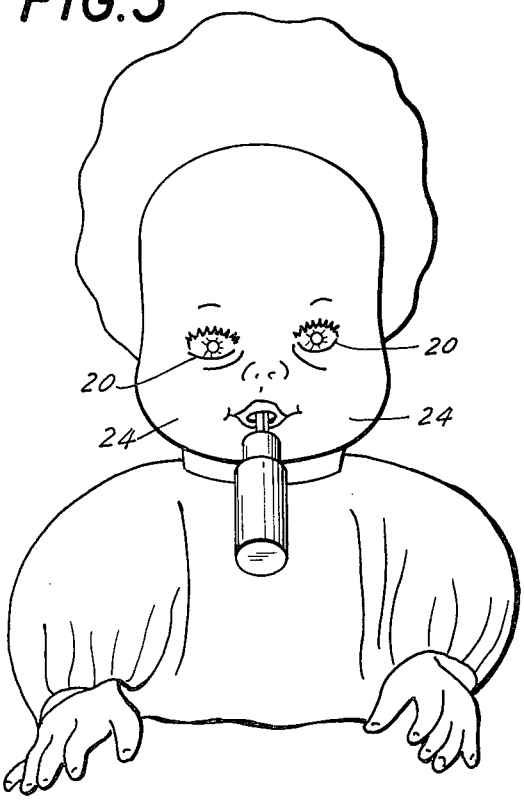
FIG. 5 is an elevational view of a drinking doll according to the present invention showing a simulated bottle inserted in the doll's mouth.
Figure 6:
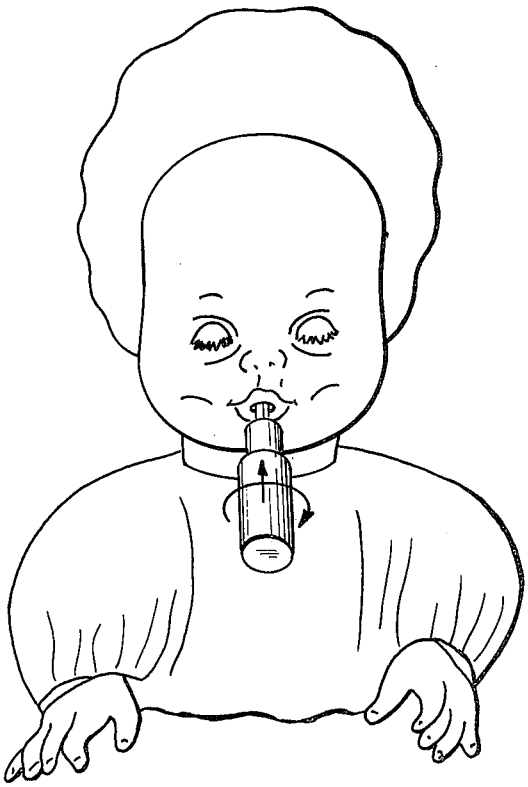
FIG. 6 is an elevational view similar to FIG. 5 showing the bottle inserted in the doll's mouth but moved inwardly in the doll's mouth to flex the doll's cheeks, and rotated in order to close the doll's eyes.
Figure 2:
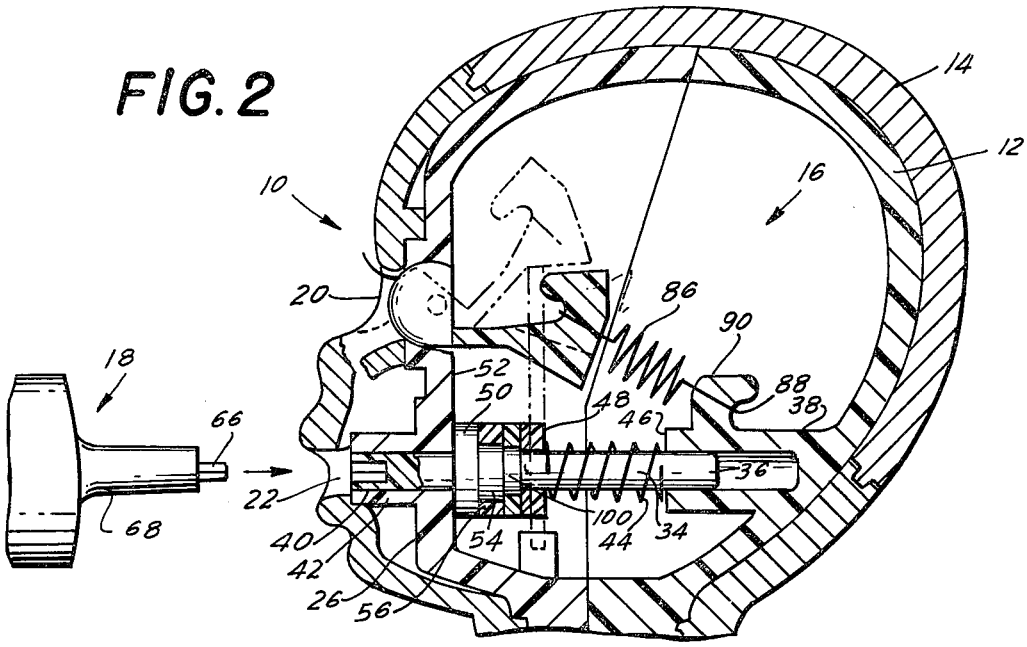
FIG. 2 is a vertical sectional view of the head of a doll assembly constructed in accordance with the present invention.

Referring now to the drawing in detail, and initially to FIGS. 1 and 2 thereof, the head portion 10 of a toy doll constructed in accordance with the present invention includes a hollow skull or frame 12 formed of a relatively rigid plastic material, covered by a layer of flexible plastic material 14 in which the facial features of the doll are molded. The hollow head assembly 12, 14 includes the operating mechanism 16 of the invention, which operates in cooperation with a simulated baby bottle 18, to open and close the doll's eyes, and to flex the cheeks of the doll's face, as formed by the skin layer 14, in order to simulate the sucking action of a baby on its bottle.

Figure 4:
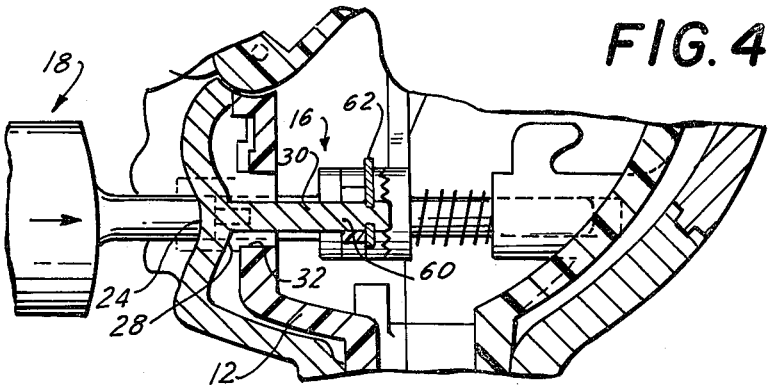
FIG. 4 is a fragmentary elevational view similar to FIG. 2 but through a cheek portion of the doll, showing the operation of the cheek flexing elements.

The doll head assembly 12, 14 includes a pair of eye apertures or openings 20 formed therein and a mouth aperture or opening 22. The cheek portions 24 of the doll's skin layer 14 extend outwardly from the front wall 26 of skull 12, to permit layer 14, at the cheeks, to be flexed. The inner surface 28 of the cheek portions 24 of the doll include integral extensions 30 which are operatively connected to operating mechanism 16, as described hereinafter, to allow flexible cheek portions 24 to be pulled towards skull 12 and simulate the sucking action of an infant on its bottle. Skull or frame 12 includes apertures 32 (only one of which is seen in FIG. 4) through which cheek extensions 30 extend, for connection with operating mechanism 16.

Operating mechanism 16 includes an actuating member or rod 34 which is slidably and rotatably mounted in skull frame 12. As seen in FIG. 2, the inner end 36 of actuator rod 34 is received in an annular collar 38 integrally formed in the rear of the skull, while the forward end 40 of the rod is rotatably received in a collar extension 42 at the front of the skull, located in alignment with mouth aperture 22 in skin layer 14. By this mounting arrangement actuator rod 34 can move longitudinally along its axis in the collars 38, 42 and also can rotate about its longitudinal axis.

Actuator rod 34 is biased into the position shown in FIG. 2, by a coiled spring element 44 which operates between the end 46 of the collar 38 and a clutch element 48 (more fully described hereinafter). This position of the actuator rod is limited by an integral collar 50 formed on the rod which engages against the inner surface 52 of skull 12 in order to define the first operative position of the actuator rod wherein end 40 of the actuator rod is located adjacent mouth aperture 22.

Actuator rod 34 includes an integral annular bushing 54 formed thereon immediately adjacent collar 50. A bracket or frame member 56 is mounted on this collar, with sufficient clearance between the bushing and the inner diameter of frame member 56 (see FIG. 1) to allow rod 34 to rotate within the frame member.

Bracket 56 includes a pair of arms 56A, 56B which extend in diametrically opposite directions from the central portion of the bracket that surrounds rod 34, to free end portions 58A and 58B which have apertures 59A, 59B formed therein receiving the inner ends 60 of cheek extensions 30 in a tight frictional engagement. To prevent inadvertent removal of extension ends 60 from apertures 59, metal clips 62 or the like are clamped on the ends of extensions 60. In this manner, cheek extensions 30 are firmly held in the frame arms 56A and 56B.

The free outer end 40 of actuator rod 34 has a polygonal recess 64 formed therein which is adapted to receive a complementary extension 66 formed on the nipple end 68 of bottle 18. This arrangement permits the end of the bottle to be coupled to the actuator rod to allow rotation of the actuator rod, as described hereinafter, and to permit the child playing with the doll to push the bottle into the doll's mouth and thus move the actuator rod towards the rear of the doll's head. This rearward movement of the actuator rod carries with it the bracket or frame member 56 and causes cheek portions 24 of the doll to be pulled inwardly with the bracket. This inward movement or flexing of cheek portions 24 of the doll's head simulates the sucking action of a child on its bottle, and can be performed regardless of the angular position of actuator rod 34.

A pair of simulated doll's eyes 70, made of plastic material in the usual manner, and being in the shape of spheres formed with simulated pupils 72 and eyelid-eyelash portions 74, are rotatably mounted in the eye sockets 20 of skull 12 by means of pivot pins 76 integrally formed therein. These pins are received in apertures 78 formed in the sides of the skull 12 adjacent eye sockets 20. The eyeballs are interconnected in spaced relationship by a U-shaped frame or bar member 80, having a relatively broad bight portion 82. This bight portion includes an integral hook 84 which is operatively engaged with a coil spring 86 having one end 88 secured to a hook 90 at the rear of skull 12. In this manner eyeballs 70 are normally held in their open position with the irises of the eyeballs visible through the eye socket apertures.

Operating mechanism 16 includes a lever element 92 integrally formed with the clutch element 48. The latter consists of an annular collar slidably and rotatably mounted on the actuator rod 34 and having an inner face 94 on which a plurality of triangularly shaped radially extending teeth are formed. This face of the clutch element 48 cooperates with the complementary face 96 of a second clutch element 98. The latter is frictionally fit on an annular boss 100 integrally formed with actuator rod 34 (see FIG. 2) so that it will rotate with the actuator rod. The two clutch elements are normally held in engagement with each other by the coil spring 44 which, as previously described, also operates to hold the actuator rod in its normal or first position illustrated in FIG. 2.

Figure 3:
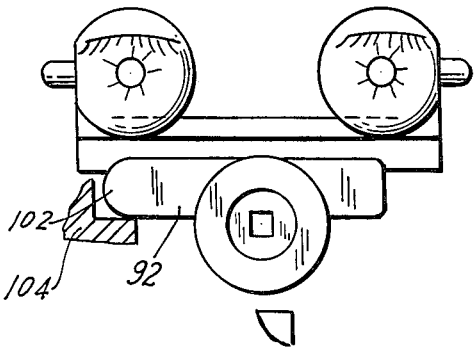
FIGS. 3 and 3A are fragmentary elevational views showing portions of the operating mechanism of FIGS. 1 and 2, controlling the operation of the eyes of the doll.
Figure 3A:
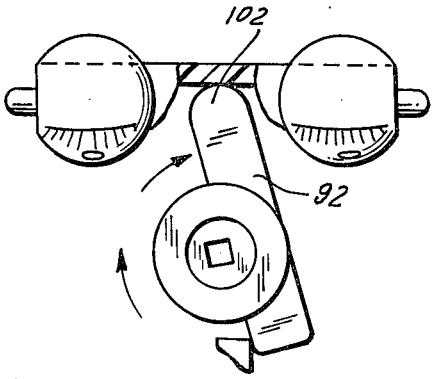

Lever 92 and clutch element 48 are normally positioned, as illustrated in FIG. 3, with the free end 102 of the lever engaged against a stop surface 104 formed in skull 12, to prevent rotation of the lever beyond the position illustrated in FIG. 3 in a counterclockwise direction. Rotation of the actuator rod 34 in a counterclockwise direction beyond this point will be permitted by operation of the clutch, wherein clutch elements 48, 98 will slip with respect to one another while the lever 92 remains in the position shown. In order to close the doll's eyes, the polygonal end portion 66 of nipple 68 is inserted in the aperture 64 at the end of the actuator rod and the bottle is turned in a clockwise direction. This will move the lever 92 (as illustrated in FIG. 3A and in phantom lines in FIG. 2) and cause its end 102 to engage the bottom surface of bight portion 82 of connecting bar 80. (In this connection it is noted that the lever is located in a position in transverse alignment with this bar in order to insure that proper engagement is achieved in any position of the actuator rod, i.e., even when the rod is pushed to its innermost position by the insertion of bottle 18 deeply into the mouth aperture of the doll). By rotating lever 92 in a clockwise direction in this manner, engagment of end 102 of the lever against bar 82 will cause the bar to be raised upwardly, as illustrated in phantom lines in FIG. 2, thus causing the eyes to pivot to their closed position. Pivotal movement of the bottle 18 in a counterclockwise direction, from this position, will release engagement of lever 92 and bar 82, and the eyes will return to their open position under the influence of spring 86.

By the above described construction, it is seen that the opening and closing of eyes 70 is completely independent from the actuation of the flexible cheek portions 24 of the doll. Likewise, the cheeks of the doll can be flexed independently of the operation of the doll's eyes. Thus the cheeks can be flexed whether the doll's eyes are fully opened, fully closed, or partially opened or closed. Thus a greater flexibility in use of the doll and the expressions which can be simulated with the doll is achieved.

Although an illustrative embodiment of the present invention has been described herein with reference to the accompanying drawings, it is to be understood that the invention is not limited to that precise embodiment thereof, but that various changes and modifications can be effected therein by one skilled in the art without departing from the scope or spirit of this invention.

What is claimed is:

1. A doll assembly comprising, a hollow head portion having a mouth aperture and a pair of flexible cheek portions, an actuator member, said actuator member comprising an elongated rod slidably mounted in said head for longitudinal sliding movement towards and away from said mouth aperture, and means for connecting said actuator member to said flexible cheek portions for flexing said cheek portions inwardly when said actuator member is moved away from said mouth aperture with said connecting means comprising a rigid frame with a central portion which surrounds said rod and is mounted on said rod for movement therewith and having a pair of arms respectively secured to the interior of said flexible cheek portions.

2. The doll assembly according to claim 1 including spring means for biasing said actuator towards said mouth opening to a position in which said cheeks are normally unflexed.

3. A doll assembly as defined in claim 1 including a bottle having an end portion sized for insertion through said mouth aperture to engage one end portion of the elongated rod in said head adjacent said mouth aperture to permit manual sliding of said rod away from said mouth aperture with said bottle end portion and against the bias of said spring means thereby to cause flexing of said flexible cheek portions.

4. A doll assembly as defined in claim 1 wherein said actuator member is rotatably mounted in said head and said hollow head portion has a pair of eye socket apertures, and said assembly includes a pair of eyeball portions mounted in said head portion adjacent said eye socket apertures, said eyeball portions being movable between a normally eye-open position and an eye-closed position; and means in said head for operatively connecting said actuator member to said eyeball portions for moving said eyeball portions from said eye-open position to said eye-closed position in response to rotation of said actuator member in a predetermined direction, regardless of the position along the path of said sliding movement of the actuator member, towards or away from said mouth aperture.

5. A doll assembly comprising, a hollow head having a mouth aperture and a pair of flexible cheek portions located adjacent the mouth aperture; an elongated actuator rod slidably mounted within said head for limited longitudinal movement; said actuator rod having one end located adjacent said mouth aperture for movement towards and away from the mouth aperture, within the confines of said hollow head; means for normally biasing said actuator rod into a first position wherein said one end thereof is located adjacent said mouth aperture; and means in said head for operatively connecting said actuator rod to said flexible cheek portions whereby said flexible cheek portions move with the rod during sliding movement thereof and flex inwardly when said one end of the actuator rod is moved away from the mouth aperture inwardly of said head with said connecting means comprising a rigid frame with a central portion which surrounds said actuator rod and is mounted on said actuator rod for movement therewith and having a pair of arms respectively secured to the interior of said flexible cheek portions.

6. A doll assembly as defined in claim 5 including a bottle having an end portion sized for insertion through said mouth aperture to engage said one end of the elongated rod in said head adjacent said mouth aperture to permit manual sliding of said rod away from said mouth aperture with said bottle and against the bias of said biasing means thereby to cause flexing of said flexible cheek portions.

7. A doll assembly as defined in claim 5 wherein said actuator rod is rotatably mounted in said head and said hollow head has a pair of eye socket apertures, and said assembly includes a pair of eyeball portions mounted in said head adjacent said eye socket apertures, said eyeball portions being movable between a normally eye-open position and an eye-closed position; and means in said head for operatively connecting said actuator rod to said eyeball portions for moving said eyeball portions from said eye-open position to said eye-closed position in response to rotation of said actuator rod in a predetermined direction, regardless of the position along the path of said sliding movement of the actuator rod with respect to said mouth aperture.

8. A doll assembly comprising, a hollow head portion having a mouth aperture and a pair of flexible cheek portions, an actuator member slidably and rotatably mounted in said head portion for sliding movement along an axis extending from said mouth aperture between the front and rear of the doll head portion and for rotary movement about said axis, means for connecting said actuator member to said flexible cheek portions for flexing said flexible cheek portions inwardly when said actuator member is moved away from said mouth aperture toward the rear of the doll head portion, said hollow head portion having a pair of eye socket apertures and a pair of simulated eyeballs rotatably mounted therein for movement between eye-open and eye-closed positions.

and means in said head portion for operatively connecting said actuator member to said eyeballs for moving said eyeballs from between said eye-open and eye-closed position in response to rotation of said actuator member, whereby said eyeballs may be opened or closed in both the flexed and unflexed positions of said flexible cheek portions.

9. A doll assembly as defined in claim 8 wherein said actuator member has one end portion located adjacent said mouth aperture and said assembly includes a bottle having an end portion sized for insertion through said mouth aperture to engage said one end portion of the actuator member in said head portion adjacent said mouth aperture to permit manual sliding of said actuator member away from said mouth aperture with said bottle thereby to flex said flexible cheek portions.

10. A doll assembly as defined in claim 9 wherein said bottle end portion and said one end portion of the actuator member include cooperating means for coupling said bottle to said actuator member to cause rotation of said actuator member when the bottle is turned.

11. A doll assembly as defined in claim 10 including means for normally biasing said actuator member into a first position wherein said one end portion thereof is adjacent said mouth aperture.

12. A doll assembly as defined in claim 8 wherein said actuator member comprises an elongated rod slidably and rotatably mounted in said head portion for longitudinal axial sliding movement and for rotation about its longitudinal axis; and said means for connecting the actuator member to said flexible cheek portions comprises a rigid frame rotatably receiving said rod and being secured thereto for longitudinal movement with the rod; said frame being secured to said flexible cheek portions and held thereby against rotation with the rod whereby longitudinal moves of said rod inwardly of the head move said frame with it to draw the flexible cheek portions inwardly in a simulated sucking action.

13. A doll assembly as defined in claim 8 wherein said actuator member comprises an elongated rod slidably and rotatably mounted in said head portion; and said means for operatively connecting the actuator member to the eyeballs of the doll includes a bar connecting said eyeballs in the interior of said head portion and a lever mounted on said rod, projecting therefrom in alignment with said bar, said lever being positioned to move in a predetermined rotational path in which the lever will engage said bar and turn said eyeballs to said eye-closed position when said rod is rotated in a predetermined direction.

14. A doll assembly as defined in claim 13 including means for normally biasing said eyeballs into their eye-open position.

15. A doll assembly as defined in claim 13 including stop means in said head limiting the rotational path of said lever to said predetermined path.

16. A doll assembly as defined in claim 15 including clutch means operatively interconnecting said rod and said lever for allowing rotation of the rod with respect to the lever when rotation of the lever is prevented by said stop means.

17. A doll assembly comprising, a hollow head portion having a mouth aperture, a pair of eye sockets having apertures, and a pair of flexible cheek portions; an elongated actuator rod having one end adjacent to and aligned with said mouth aperture and being slidably and rotatably mounted within the interior of said head portion for sliding movement along its longitudinal axis toward and away from said mouth aperture and for rotary movement about said longitudinal axis; spring means normally biasing said rod toward a first position wherein said one end thereof is adjacent the mouth aperture; a bracket mounted on said rod for longitudinal movement therewith while permitting the rod to rotate therein; said bracket being operatively connected to said flexible cheek portions to flex said cheek portions inwardly when said one end of the rod is moved away from said mouth aperture;

a pair of simulated eyeballs rotatably mounted in said eye sockets for movement between eye-open and eye-closed positions; a bar rigidly holding said eyeballs together in the interior of said head; means in said head for normally biasing said eyeballs to said eye-open position; and a lever mounted on said rod for rotation therewith and projecting therefrom in transverse alignment with said bar; said lever being positioned to move in a predetermined rotational path in which the lever will engage said bar and turn said eyeballs to said eye-closed position when the rod is rotated in a predetermined direction, regardless of the position of said one end portion of the actuator rod with respect to said mouth aperture.

18. A doll assembly as defined in claim 17 including a bottle having an end portion sized for insertion through said mouth aperture to engage said one end portion of the actuator rod in said head portion adjacent the mouth aperture to permit manual sliding of said actuator rod away from the mouth aperture with the bottle end portion against the bias of said spring means thereby to flex said flexible cheek portions.

19. A doll assembly as defined in claim 18 wherein said bottle end portion and said one end portion of the actuator rod include cooperating means for coupling said bottle to said actuator rod to cause rotation of said actuator rod when the bottle is turned.

20. A doll assembly as defined in claim 19 including stop means in said head portion limiting the rotational path of said lever to said predetermined path.

21. A doll assembly as defined in claim 20 including clutch means operatively interconnecting said rod and said lever for allowing rotation of the rod with respect to the lever when rotation of the lever is prevented by said stop means.

* * * * *